United States Patent [19]

Stoler

[11] Patent Number: 4,683,356

[45] Date of Patent: Jul. 28, 1987

[54] TAUT WIRE FENCE SYSTEM AND SENSOR THEREFOR

[75] Inventor: Arie Stoler, Holon, Israel

[73] Assignee: Israel Aircraft Industries Ltd., Israel

[21] Appl. No.: 882,431

[22] Filed: Jul. 7, 1986

Related U.S. Application Data

[63] Continuation of Ser. No. 658,883, Oct. 9, 1984, abandoned.

[30] Foreign Application Priority Data

Oct. 10, 1983 [IL] Israel ..... 69945

[51] Int. Cl.[4] ..... A01K 3/00; G08B 13/00; H01H 3/02

[52] U.S. Cl. ..... 200/61.93; 256/10; 340/541

[58] Field of Search ..... 256/10; 340/541; 200/52 R, 61.93, 80 R, 61.58 R, 161

[56] References Cited

U.S. PATENT DOCUMENTS

| | | | |
|---|---|---|---|
| 2,350,290 | 5/1944 | Moore | 200/61.93 |
| 3,634,638 | 1/1972 | Even-Tov et al. | 200/80 R |
| 3,867,599 | 2/1975 | Moen | 200/161 X |
| 3,912,893 | 10/1975 | Stoler | 200/153 T X |
| 4,196,890 | 4/1980 | Einhorn | 256/10 X |
| 4,222,042 | 9/1980 | Cantley | 200/61.93 X |
| 4,367,459 | 1/1983 | Amir et al. | 200/61.93 X |

*Primary Examiner*—J. R. Scott

*Attorney, Agent, or Firm*—Poms, Smith, Lande & Rose

[57] ABSTRACT

A sensor for taut wire fence systems comprising first and second taut wire connection terminals arranged for relative motion relative to each other, and first and second electrical contacts, each associated with a respective one of the first and second connection terminals and arranged such that a predetermined relative motion between the first and second connection terminals produces an electrical connection between the first and second electrical contacts.

13 Claims, 6 Drawing Figures

TAUT WIRE FENCE SYSTEM AND SENSOR THEREFOR

This is a continuation of co-pending application Ser. No. 658,883 filed on 10/9/84 now abandoned.

BACKGROUND OF THE INVENTION

1. Field of the Invention

The present invention relates to protective fences generally and more particularly to taut wire protective fences.

2. Description of the Related Art

Various types of taut-wire protective fences are known in the patent literature and in the marketplace. Simply described, taut wire protective fences incorporate tensioned wires which are connected to sensors. These sensors provide an alarm indication of an attempt to climb or cut the fence. U.S. Pat. Nos. 3,634,638 and 3,912,893, owned by applicants, describe sensors which are particularly suited for taut wire fence applications and which have found wide market acceptance.

Applicant has in the past constructed taut wire fence installations wherein a plurality of wires are connected to a common terminal of a single sensor. Such an arrangement is also shown in later filed and published Israel Patent Application 60240, wherein a common member is used to attach a plurality of taut wires to a common terminal of a sensor.

SUMMARY OF THE INVENTION

The present invention seeks to provide a sensor for taut wire fence systems which has two terminals at opposite ends of the sensor, for mechanical attachment to two different taut wires.

There is thus provided in accordance with a preferred embodiment of the present invention a sensor for a taut wire fence comprising a plurality of generally parallel taut wires, which sensor comprises a first terminal at one end of the sensor adapted for rigid attachment thereto of a first taut wire, and a second terminal at the opposite end of the sensor adapted for rigid attachment thereto of a second taut wire, the first and second taut wire attachment terminals being in turn rigidly attached to respective mutually juxtaposed and joined first and second housings for motion relative to each other, by virtue of the fact that the housings are so constructed that the potential for relative motion of one of the housings is subject to less mechanical restraint than the potential for relative motion of the other of the housings; first and second electrical contacts, disposed within the mutually juxtaposed and joined housings, each of the contacts being respectively moveable in response to a movement imposed by a predetermined dislocation from a rest position of one or other rigid-ly attached taut wires acting through a respective one of the first and second attachment terminals, the disposition of the contacts within the housings being such that a predetermined relative motion between the first and second attachment terminals produces an electrical connection between the first and second electrical contacts; means located on the sensor between the one and opposite ends for mounting it on an upright rigid support such that the sensor as a whole is pivotable on the support for pivotal motion substantially only in the plane defined by the taut wires attached thereto; and at least one of the first and second attachment terminals being electrically insulated from the first and second electrical contacts.

Further in accordance with a preferred embodiment of the present invention, the second housing comprises a generally rigid base portion of the sensor, and the first housing comprises a flexible mounting portion of the sensor associated therewith.

Additionally in accordance with a preferred embodiment of the present invention, the first attachment terminal comprises an elongate element incorporated within the first housing and which terminates in the first electrical contact, while the second electrical contact is mounted relative to the base portion by means of a flowable material which permits repositioning of the contact relative to the base portion under conditions of low stress, characteristic of temperature change induced movements and which is rigid under conditions of high stress, such as produced by attempted penetration of the fence by an intruder.

A preferred flowable material is silicone putty such as General Electric G - E SS-91 Silicone Bouncing Putty.

Further in accordance with a preferred embodiment of the present invention, the first and second electrical contacts are joined together by a bendable relatively weak electrically insulative coupling which maintains the spacing of the contacts under temperature induced movements when the flowable material acts in a non-rigid manner, but which permits relative movement between the contacts when the flowable material acts in a rigid manner.

Additionally in accordance with a preferred embodiment of the invention, a bracket is provided for attaching the sensor directly or indirectly to its support, on which bracket the sensor is pivotably mounted so as to permit pivotal motion of the sensor substantially only in the plane defined by the taut wires attached thereto.

In accordance with a further aspect of the invention, there is provided a taut wire fence system which comprises a plurality of generally parallel taut wires, a plurality of upright sensor supports a plurality of sensors, at least one sensor being mounted on each of the plurality of sensor supports, each of the sensors being of the type described hereinabove, and the electrical connection referred to between the first and second electrical contacts being effective to provide an alarm indication.

Additionally in accordance with a preferred embodiment of the present invention, the sensor supports comprise extruded profiles which define channels along the length thereof for mounting of the sensors thereto at selectable locations therealong. Additionally in accordance with an embodiment of the invention, the sensor support profiles also define wiring channels and channels for receiving joining members which engage adjacent sections of the support profiles.

BRIEF DESCRIPTION OF THE DRAWINGS

The present invention will be understood and appreciated more fully from the following detailed description taken in conjunction with the drawing in which.

DESCRIPTION OF THE PREFERRED EMBODIMENTS

Figure 1:
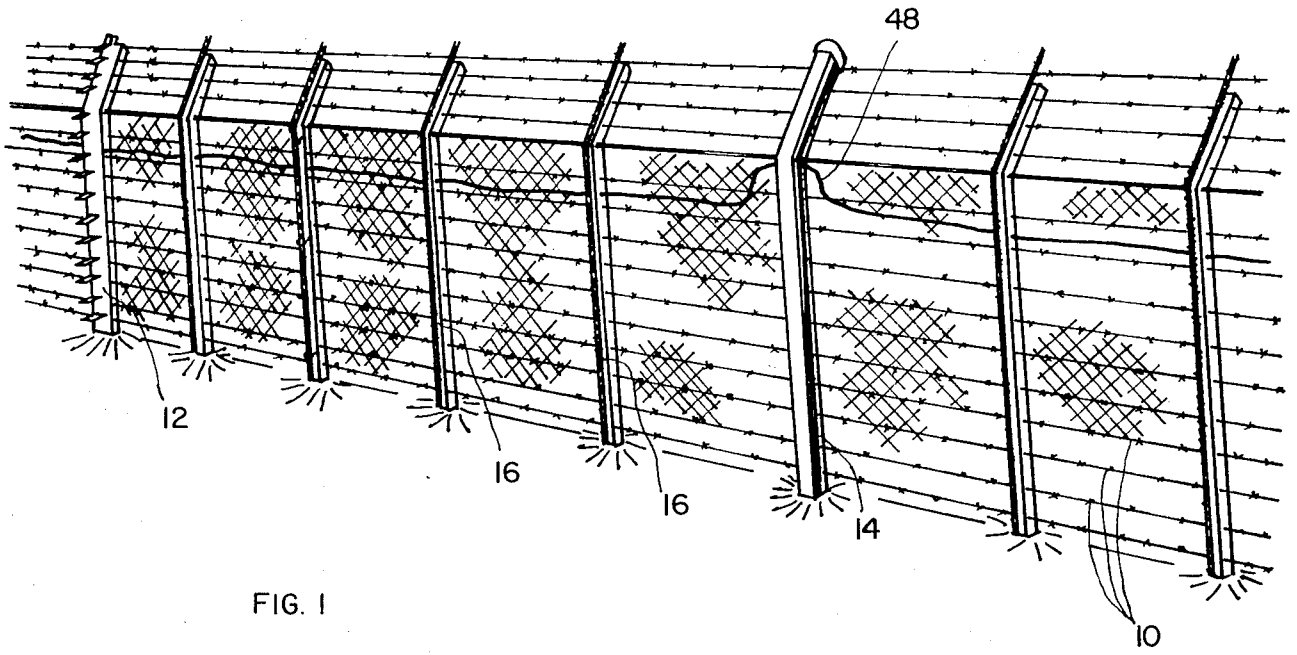
FIG. 1 is a pictorial illustration of a portion of a taut wire fence constructed and operative in accordance with a preferred embodiment of the present invention.

Reference is now made to FIG. 1 where there is shown a portion of a taut-wire intrusion detection fence system comprising taut wires 10 strung in generally parallel orientation and mounted between an anchoring post 12 and a sensor post 14. Intermediate the anchoring post 12 and the sensor post 14 are a plurality of intermediate posts 16.

Figure 3:
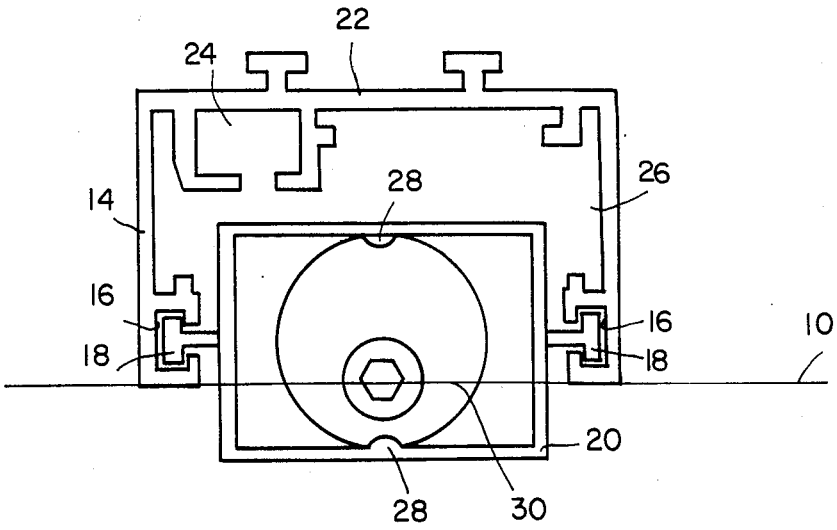
FIG. 3 is a top view illustration taken along the lines III—III of FIG. 2.

According to a preferred embodiment of the present invention, the sensor post 14 is formed as a unitary elongate element having a uniform cross section. Preferably sensor post 14 comprises an extruded member having a cross section as illustrated in FIG. 3. The particular cross section of the sensor post 14 defines a pair of inner facing mounting channels 16 which accomodate fasteners 18 which are associated with sensor mounting brackets 20, such as those illustrated in FIGS. 4A and 4B.

Sensor post 14 also preferably defines outer channels 22 which are employed for mounting of the sensor post 14 onto ground anchored supports (not shown), and additional inner channels 24 and 26 which serve as wiring channels and for receiving joining members which can be used for joining two sections of post end to end.

Figure 2:
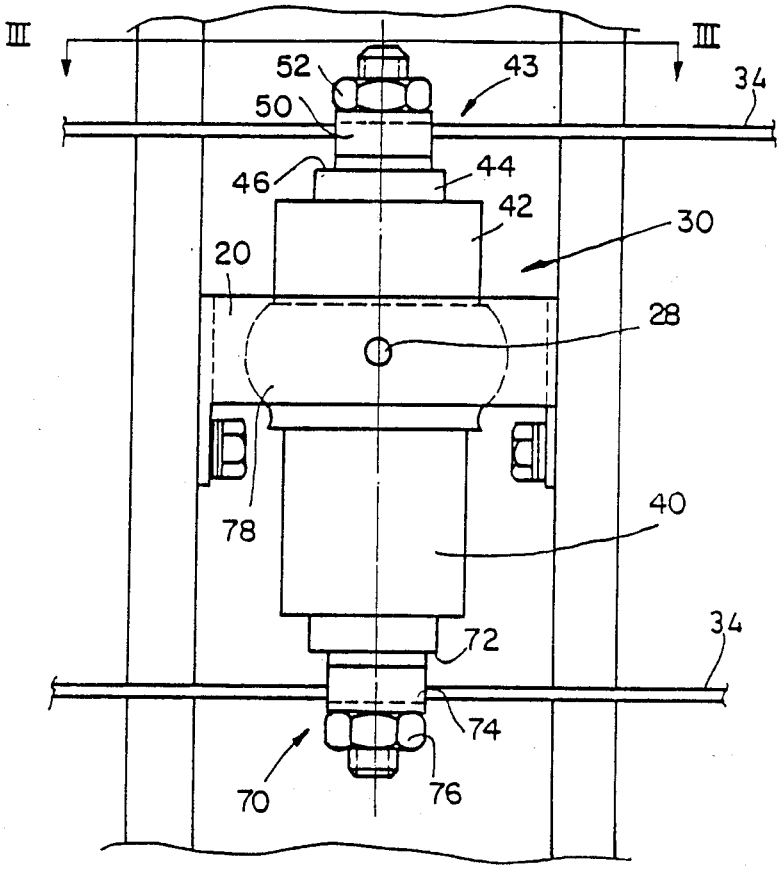
FIG. 2 is a side view illustration illustrating a taut wire fence sensor mounted onto a support post and having taut wires mounted thereon.
Figure 4A:
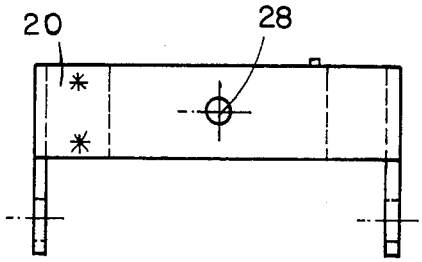
FIGS. 4A and 4B are respective side and top view illustrations of an intermediate pivotal mounting element employed in mounting the sensor onto the support post.
Figure 4B:
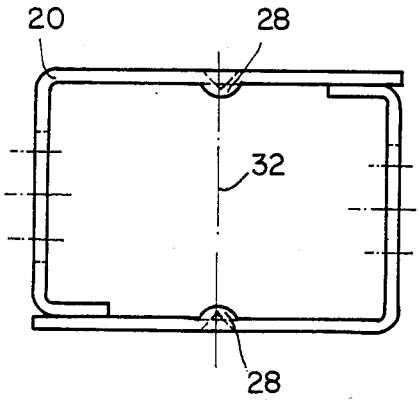

Referring now additionally to FIGS. 2, 4A and 4B, it is seen that sensor mounting brackets 20 define a pair of oppositely disposed protrusions 28 which engage suitably located recesses formed in the body of sensors 30, one of which is illustrated in FIG. 2, providing pivotable mounting of sensors 30 about an axis defined by the imaginary line 32 joining protrusions 28. Thus it may be appreciated that sensors 30 are pivotable relative to the sensor post in a plane parallel to the sensor post and in which plane lay the taut wires 34 which are attached to the sensors as will be described hereinbelow.

Figure 5:
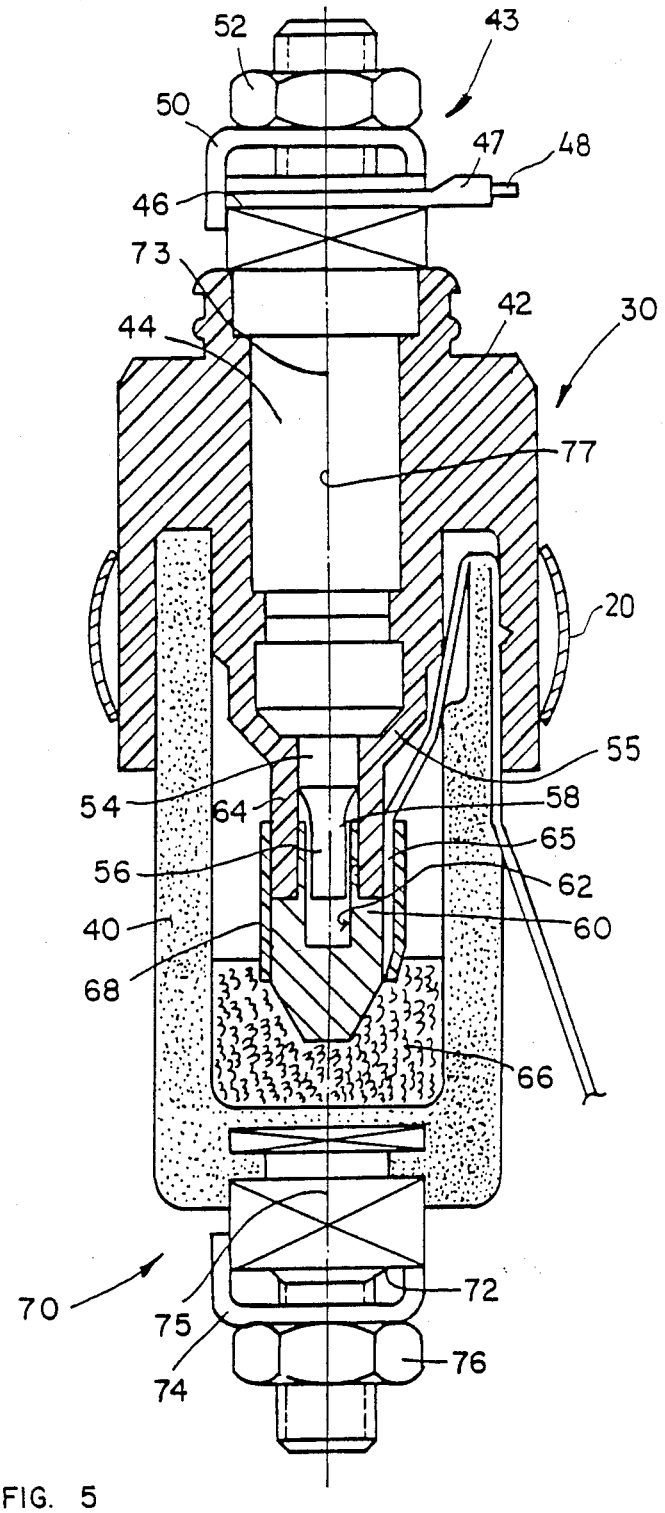
FIG. 5 is a side view, sectional illustration of a sensor constructed and operative in accordance with a preferred embodiment of the present invention and useful in the fence of FIG. 1.

Referring now additionally to FIG. 5 it is seen that the sensor 30, comprises a relatively rigid base 40, typically formed of LEXAN and having a generally cup-like configuration. Mounted onto base 40 is a flexible top sealing member 42, typically formed of EPDM or Neoprene rubber. Sealingly mounted in flexible top sealing member 42 is a first taut wire connection terminal assembly 43 comprising an elongate pin 44 which extends from the exterior of member 42 to the interior of base member 40. The outer part of assembly 43 comprises a clamp support base 46, which is integrally formed with pin 44, an electrical conductor connector 47, which is coupled to an electrical circuit which is connected to control apparatus (not shown) via conductors 48 (FIG. 1), a taut wire clamp 50 and a tightening nut 52 which engages a threaded top surface of pin 44.

The interior portion of pin 44 defines a relatively narrow portion 54, which is generally surrounded by a cylindrical electrically insulative portion 55 of top sealing member 42 and which terminates in an electrical contact element 56, defining a cylindrical contact surface 58.

A second electrical contact element 60, defining a cylindrical contact surface 62, is coupled to contact element 56 by means of an electrically insulative generally cylindrically shaped joining member 64, and is coupled to an electrical conductor 65. Joining member 64, which is typically formed of rubber and defines a continuation of element 42 serves to maintain contact surfaces 58 and 62 in spaced, non-conducting relationship in the absence of external forces applied thereto above a predetermined threshold. This predetermined threshold is typically selected such that deformation of joining member 64 occurs and electrical contact is established between contact elements 56 and 60 producing an electrical circuit through the sensor and signalling an alarm when the respective longitudinal axes of the taut wire terminals are skewed with respect to each other by about 3–4 degrees.

Electrical contact element 60 is mounted in a body of a flowable material 66 located within base 40 and which permits repositioning of the contact relative to the base portion under conditions of low stress, characteristic of temperature change induced movements and which is rigid under conditions of high stress, such as produced by attempted penetration of the fence by an intruder. A preferred flowable material is silicone putty such as General Electric G - E SS-91 Silicone Bouncing Putty. It may be appreciated that under temperature induced movements, both contact elements 56 and 60 tend to move together and thus retain their spaced relationship. When a sudden movement of one relative to the other occurs and the flowable material acts rigidly, deformation of joining member 64 occurs and electrical contact is established across the contact elements 56 and 60.

An insulative shield 68 is provided surrounding most of contact element 60 to prevent chemical interaction between the silicone putty and the connection of the conductor 65 to element 60.

A second taut wire connection terminal assembly 70 is rigidly mounted onto base 40 and comprises an integrally formed clamp base 72, a taut wire clamp 74 and a tightening nut 76. It is noted that terminal assembly 70 is electrically insulated from electrical contacts 56 and 60.

A peripheral mounting belt 78 is disposed about the center of sensor 30 and, as shown, is formed with a pair of oppositely directed recesses or apertures for accomodating protrusions 28 for pivotable mounting thereof.

The operation of the taut wire fence and of the sensor and their particular advantages will be described briefly hereinbelow. It can be appreciated that displacement of one of the taut wire connection terminals relative to the other in the plane of the wires 10 as shown in FIG. 5 may be balanced and thus cause pivoting of the entire sensor about its pivot mounting axis defined by protrusions 28 (FIG. 2). Any unbalanced relative displacement produces relative skewing of the longitudinal axis 73 of the first terminal relative to the longitudinal axis of the second terminal 75, typically about a pivot axis located approximately at a location indicated by reference numeral 77. The location of this pivot axis may change and vary due to the flexible nature of the coupling provided by rubber cover element 42.

Under conditions wherein the flowable material acts rigidly, such as upon attempted intrusion through the fence, by an intruder placing weight on the wires or cutting the wires, displacement of the taut wires by at least about 1.8–2.0 mm produces electrical contact between the contact elements 56 and 60 and thus provides an alarm indication. In the illustrated embodiment, the required angular displacement between the axes of the two terminal assemblies, is approximately 3–4 degrees.

In accordance with the present invention, in order to significantly increase sensitivity to usual types of intrusion occurances without increasing the false alarm rate, the sensor is responsive to the relative movement of two adjacent taut wires, rather than the relative motion of one wire relative to a fixed sensor post, as in the prior art. Thus when an intruder attempts to spread two adjacent wires apart, so as to squeeze therebetween, both wires are displaced simultaneously, producing an alarm in response to a significantly smaller total displacement of each wire than would have been required employing the prior art apparatus.

It will be appreciated by persons skilled in the art that the present invention is not limited to what has been particularly shown and described hereinabove. Rather, the scope of the present invention is defined only by the claims which follow:

I claim:

1. A sensor for a taut wire fence comprising a plurality of generally parallel taut wires, which sensor comprises:

a first terminal at one longitudinal end of the sensor comprising a first clamp connector for allowing rigid attachment thereto of a first taut wire, and a second terminal at the opposite longitudinal end of the sensor comprising a second clamp connector for allowing rigid attachment thereto of a second taut wire, each of said first and second taut wire attachment terminals being rigidly attached to a respective first and second sensor housing portion, said sensor housing portions lying on respective longitudinal axes which ar collinear with each other and with said longitudinal sensor ends in a rest position of said first and second taut wires, said first sensor housing portion being mounted onto said second housing portion so as to enable relative motion therebetween by skewing between their respective longitudinal axes;

means located on the sensor between said longitudinal sensor ends for mounting it in pivotal fashion on an upright rigid support such that the sensor as a whole is pivotable substantially only in the plane defined by the taut wires attached thereto; and first and second electrical contacts each disposed within a respective one of said sensor housing portions, at least one of said first and second electrical contacts being electrically insulated from said first and second attachment terminals, each of said respective electrical contacts being movable in response to a pivoting movement of said sensor imposed by a predetermined dislocation from said rest position of either of said first or second taut wires acting through a respective one of the first and second attachment terminals, the disposition of said contacts within said respective sensor housing portions being such that a predetermined relative motion between said first and second attachment terminals produces an electrical connection between said first and second electrical contacts.

2. Apparatus according to claim 1 and wherein said second housing portion comprises a generally rigid base portion of the sensor and said first housing portion comprises a flexible mounting portion of the sensor associated therewith.

3. Apparatus according to claim 2 wherein said first attachment terminal comprises an elongate element incorporated within said flexible mounting portion and which terminates in said first electrical contact, while said second electrical contact is seated within said base portion by means of a flowable material contained therein, said second electrical contact being electrically connected to an internal end of an externally directed electrical conductor, said flowable material permitting repositioning of said second electrical contact relative to the base portion under conditions of low stress, characteristic of temperature change induced movements and which is rigid under conditions of high stress, such as produced by attempted penetration of the fence by an intruder.

4. Apparatus according to claim 3 and wherein said flowable material comprises silicone putty.

5. Apparatus according to claim 3 and wherein said first and second electrical contacts are joined together by a bendable relatively weak electrically insulative coupling which maintains the spacing of the contacts under temperature induced movements when said flowable material acts in a non-rigid manner, but which permits relative movement between the contacts when the flowable material acts in a rigid manner.

6. Apparatus according to claim 1 and including also a bracket for attaching the sensor to said support, on which bracket said sensor is pivotably mounted so as to permit pivotal motion of the sensor substantially only in the plane defined by the taut wires attached thereto.

7. A taut wire fence system which comprises a plurality of generally parallel taut wires, a plurality of upright sensor supports and a plurality of sensors for providing an alarm indication, at least one sensor being mounted on each of said plurality of sensor supports, each of said sensors comprising:

a first terminal at one longitudinal end of the sensor comprising a first clamp connector for allowing rigid attachment thereto of a first taut wire, and a second terminal at the opposite longitudinal end of the sensor comprising a second clamp connector for allowing rigid attachment thereto of a second taut wire, each of said first and second taut wire attachment terminals being rigidly attached to a respective first and second sensor housing portion, said sensor housing portions lying on respective longitudinal axes which are collinear with each other and with said longitudinal sensor ends in a rest position of said first and second taut wires, said first sensor housing portion being mounted onto said second housing portion so as to enable relative motion therebetween by skewing between their respective longitudinal axes;

means located on the sensor between said longitudinal sensor ends for mounting it in pivotal fashion on an upright rigid support such that the sensor as a whole is pivotable substantially only in the plane defined by the taut wires attached thereto; and first and second electrical contacts each disposed within a respective one of said sensor housing portions, at least one of said first and second electrical contacts being electrically insulated from said first and second attachment terminals, each of said respective electrical contacts being movable in response to a pivoting movement of said sensor imposed by a predetermined dislocation from said rest position of either of said first or second taut wires acting through a respective one of the first and second attachment terminals, the disposition of said contacts within said respective sensor housing portions being such that a predetermined relative motion between said first and second attachment terminals produces an electrical connection between said first and second electrical contacts, which electrical connection provides said alarm indication.

8. Apparatus according to claim 7 and wherein said sensor supports comprise profiles which define channels along the length thereof for mounting of the sensors thereto at selectable locations therealong.

9. System according to claim 7 and wherein said second housing portion comprises a generally rigid base portion of the sensor and said first housing portion comprises a flexible mounting portion of the sensor associated therewith.

10. System according to claim 9 wherein said first attachment terminal comprises an elongate element incorporated within said flexible mounting portion and which terminates in said first electrical contact, while said second electrical contact is seated within said base portion by means of a flowable material contained therein, said second electrical contact being electrically connected to an internal end of an externally directed electrical conductor, said flowable material permitting repositioning of said second electrical contact relative to the base portion under conditions of low stress, characteristic of temperature change induced movements and which is rigid under conditions of high stress, such as produced by attempted penetration of the fence by an intruder.

11. System according to claim 10 and wherein said first and second electrical contacts are joined together by a bendable relatively weak electrically insulative coupling which maintains the spacing of the contacts under temperature induced movements when said flowable material acts in a non-rigid manner, but which permits relative movement between the contacts when the flowable material acts in a rigid manner.

12. System according to claim 10 and wherein said flowable material comprises silicone putty.

13. System according to claim 7 and wherein each of said sensors is provided with a bracket for attaching the sensor to its support, on which bracket said sensor is pivotably mounted so as to permit pivotal motion of the sensor substantially only in the plane defined by the taut wires attached thereto.

* * * * *